US010201850B2

(12) United States Patent
Dai et al.

(10) Patent No.: US 10,201,850 B2
(45) Date of Patent: Feb. 12, 2019

(54) LOCAL EXTRUSION DEVICE FOR HIGH-PRESSURE CASTING

(71) Applicant: CITIC Dicastal CO., LTD., Qinhuangdao, Hebei (CN)

(72) Inventors: Chuan Dai, Qinhuangdao (CN); Fengjun Zhang, Qinhuangdao (CN); Yongning Wang, Qinhuangdao (CN); Zhihua Zhu, Qinhuangdao (CN); Changhai Li, Qinhuangdao (CN)

(73) Assignee: CITIC DICASTAL CO., LTD., Qinhuangdao, Hebei (CN)

( * ) Notice: Subject to any disclaimer, the term of this patent is extended or adjusted under 35 U.S.C. 154(b) by 0 days.

(21) Appl. No.: 15/620,061

(22) Filed: Jun. 12, 2017

(65) Prior Publication Data

US 2017/0361373 A1 Dec. 21, 2017

(30) Foreign Application Priority Data

Jun. 16, 2016 (CN) ..... 2016 1 0427017

(51) Int. Cl.
*B22D 17/20* (2006.01)
*B22D 17/26* (2006.01)

(52) U.S. Cl.
CPC ..... *B22D 17/203* (2013.01); *B22D 17/2015* (2013.01); *B22D 17/266* (2013.01)

(58) Field of Classification Search
CPC .... B22D 17/2069; B22D 17/11; B22D 17/20; B22D 17/22
See application file for complete search history.

(56) References Cited

U.S. PATENT DOCUMENTS

| | | | | | |
|---|---|---|---|---|---|
| 5,161,598 | A * | 11/1992 | Iwamoto | B22D 27/11 164/120 |
| 5,555,924 | A * | 9/1996 | Iwamoto | B22D 17/32 164/120 |
| 5,623,984 | A * | 4/1997 | Nozaki | B22D 17/32 164/120 |
| 6,810,940 | B2 * | 11/2004 | Tsuji | B22D 27/11 164/120 |

FOREIGN PATENT DOCUMENTS

| | | | |
|---|---|---|---|
| CN | 202224632 | U | 5/2012 |
| CN | 103658593 | A | 3/2014 |
| CN | 203526510 | U | 4/2014 |
| CN | 204842909 | U | 12/2015 |
| CN | 205927052 | U | 2/2017 |
| JP | 2-59160 | A | 2/1990 |
| JP | 4-123856 | A | 4/1992 |
| JP | 5-123846 | A | 5/1993 |
| JP | 2002-283033 | A | 10/2002 |

* cited by examiner

*Primary Examiner* — Kevin E Yoon
(74) *Attorney, Agent, or Firm* — Cooper Legal Group, LLC

(57) ABSTRACT

The disclosure provides a local extrusion device for high-pressing casting. The local extrusion device for high-pressure casting includes an extrusion core sleeve, an extrusion rod, an extrusion oil cylinder and an extrusion oil cylinder piston. The extrusion oil cylinder includes the extrusion oil cylinder piston, the extrusion oil cylinder piston is connected with the extrusion rod, the extrusion rod is positioned in the extrusion core sleeve, and the extrusion core sleeve and the extrusion oil cylinder are fixed.

7 Claims, 2 Drawing Sheets

LOCAL EXTRUSION DEVICE FOR HIGH-PRESSURE CASTING

CROSS-REFERENCE TO RELATED APPLICATIONS

This application is filed based upon and claims priority to Chinese Patent Application No. 201610427017.4, filed on Jun. 16, 2016, the entire contents of which are incorporated herein by reference.

TECHNICAL FIELD

The disclosure relates to the field of casting, in particular to a local extrusion device for high-pressure casting.

BACKGROUND

Dies are essential process equipment of the modern industry, particularly industries of automobiles, radio, aviation, instruments, articles of everyday use and the like. At present, because a die-casting fitting is complicated in structure, uneven in wall thickness and relatively short in solidification time, for 'hot spot' positions in the structure of the product, methods of feeding by high pressure boosting, optimizing a pouring gate structure, enhancing cooling and the like are frequently used, but feeding on the position of a far sprue is quite difficult to implement by adjustment of technological parameters, and porosity quite difficultly meets increasing requirements of customers of automobile companies.

SUMMARY

With regard to technical requirements of the aluminum alloy pressing casting, the disclosure provides a local extrusion structure and technology for high-pressure casting dies. The local extrusion structure and technology for high-pressure casting dies can be used for reducing the defect of shrinkage porosity at hot spot positions of the product, the internal quality of the product is improved, and the problems of porosity are reduced.

In one aspect of the disclosure, a local extrusion device for high-pressure casting is provided, the local extrusion device for high-pressure casting includes an extrusion core sleeve (03), an extrusion rod (04), an extrusion oil cylinder (05) and an extrusion oil cylinder piston (06), and is characterized in that the extrusion oil cylinder (05) includes the extrusion oil cylinder piston (06), the extrusion oil cylinder piston (06) is connected with the extrusion rod (04), the extrusion rod (04) is positioned in the extrusion core sleeve (03), and the extrusion core sleeve (03) and the extrusion oil cylinder (05) are fixed.

In a preferred aspect of the disclosure, the extrusion core sleeve (03) includes a cavity (12) in a direction facing a casting (01).

In a preferred aspect of the disclosure, the ratio of the cross sectional area of the extrusion oil cylinder piston (06) to the cross sectional area of the extrusion rod (04) is greater than 10.

In a preferred aspect of the disclosure, the ratio of the cross sectional area of the extrusion oil cylinder piston (06) to the cross sectional area of the extrusion rod (04) is 10-40.

In a preferred aspect of the disclosure, the ratio of the cross sectional area of the extrusion oil cylinder piston (06) to the cross sectional area of the extrusion rod (04) is 12.

In a preferred aspect of the disclosure, when the extrusion oil cylinder piston (06) is not extruded, a front end (08) of the extrusion rod is higher than an end surface (10) of the extrusion sleeve by 4-10 mm.

In a preferred aspect of the disclosure, a gap between a lower cavity inner wall (11) of the extrusion core sleeve and the extrusion rod (04) is 4-10 mm.

In a preferred aspect of the disclosure, the ratio of the cross sectional area of the extrusion oil cylinder piston (06) to the cross sectional area of the extrusion rod (04) is 12; when the extrusion oil cylinder piston (06) is not extruded, the front end (08) of the extrusion rod is higher than the end surface (10) of the extrusion sleeve by 10 mm; and the gap between the lower cavity inner wall (11) of the extrusion core sleeve and the outline of the extrusion rod (04) is 4 mm.

In another aspect of the disclosure, a local extrusion method in a high-pressure casting process is further disclosed, and is characterized in that the method includes the following steps: driving the extrusion oil cylinder piston (06) by using the local extrusion device for high-pressure casting; and driving the extrusion rod (04) to extrude the surface of the casting.

In a preferred aspect of the disclosure, the extrusion stroke of the extrusion rod (04) reaches 10-30 mm, and the distance from the front end (08) of the extrusion rod to the surface (07) of the casting is 2-5 mm after extrusion.

In a preferred aspect of the disclosure, timing is started at a two-speed transformation point, extrusion starting time is 0.5-3 s, and extrusion delay time is 3-15 s.

In a preferred aspect of the disclosure, a returned local extrusion core is pushed out again for spraying.

In another aspect of the disclosure, a local extrusion structure for high-pressure casting and a technological process are further provided, and the local extrusion structure for aluminum alloy high-pressure casting includes an extrusion boss (02), an extrusion core sleeve (03), an extrusion rod (04), an extrusion oil cylinder (05) and an extrusion oil cylinder piston (06). The ratio of the cross sectional area of the extrusion piston (06) to the cross sectional area of the extrusion rod (04) is greater than 10 to guarantee a big enough extrusion force. When the oil cylinder piston is not extruded (located at a zero position), a front end (08) of the extrusion rod is higher than an end surface (10) of the extrusion sleeve by 4-10 mm, and meanwhile, a cavity (12) is formed between the front end (08) of the extrusion rod and a lower cavity inner wall (11) of the extrusion core sleeve; and in an extrusion process of the extrusion rod, a gap between the lower cavity inner wall (11) of the extrusion core sleeve and the extrusion rod (04) is 4-10 mm (which is also the range of the wall thickness of the extrusion boss (02)). In order to guarantee good extrusion effect of the local extrusion technology, local extrusion starting time and local extrusion delay time on a die-casting machine are adjusted, the extrusion stroke of the extrusion rod is enabled to reach 10-30 mm, the distance from the front end (08) of the extrusion rod to the surface (07) of a casting is 2-5 mm after extrusion, an X-ray flaw detection machine detects a thick and large part of the casting (01), and the result shows that the defect of shrinkage porosity does not exist. In the local extrusion technology, the extrusion starting time (timing is started at a two-speed transformation point) is 0.5-3 s, the extrusion delay time is 3-15 s, in a spraying cycle, the returned local extrusion core is required to be pushed out again for spraying to cool and lubricate the extrusion core well, jamming in an extrusion process is prevented, and the service life of the local extrusion core is prolonged.

The disclosure discloses a local extrusion structure and technology for high-pressure casting, the local extrusion structure for aluminum alloy high-pressure casting includes an extrusion boss (02), an extrusion core sleeve (03), an extrusion rod (04), an extrusion oil cylinder (05) and an extrusion oil cylinder piston (06). The local extrusion structure for aluminum alloy high-pressing casting is characterized in that the ratio of the cross sectional area of the extrusion oil cylinder piston (06) to the cross sectional area of the extrusion rod (04) is required to be greater than 10 to guarantee a big enough extrusion force. In a preferred aspect of the disclosure, when the oil cylinder piston is not extruded (located at a zero position), a front end (08) of the extrusion rod is higher than an end surface (10) of the extrusion sleeve by 4-10 mm, and meanwhile, a cavity (12) is formed between the front end (08) of the extrusion rod and a lower cavity inner wall (11) of the extrusion core sleeve; in an extrusion process of the extrusion rod, a gap between the lower cavity inner wall (11) of the extrusion core sleeve and the extrusion rod (04) is 4-10 mm (which is also the range of the wall thickness of the extrusion boss (02), the heat storage capacity of the extrusion cavity (12) can be guaranteed, and the circumstance that molten aluminum is solidified too early after entering the cavity and the adjustable range of the local extrusion technology is narrowed is prevented). In order to guarantee good extrusion effect of the local extrusion technology, local extrusion starting time and local extrusion delay time on a die-casting machine are required to be adjusted, the extrusion stroke of the extrusion rod is enabled to reach 10-30 mm, the distance from the front end (08) of the extrusion rod to the surface (07) of a casting is 2-5 mm after extrusion, an X-ray flaw detection machine detects a thick and large part of the casting (01), and the result shows that the defect of shrinkage porosity does not exist. In a preferred aspect of the disclosure, the extrusion starting time (timing is started at a two-speed transformation point) is 0.5-3 s, and the extrusion delay time is 3-15 s in the local extrusion technology. In a preferred aspect of the disclosure, the returned local extrusion core is required to be pushed out again for spraying to cool and lubricate the extrusion core well in a spraying cycle, jamming in an extrusion process is prevented, and the service life of the local extrusion core is prolonged.

The local extrusion device and method for high-pressure casting provided by the disclosure have the advantages that the structural design is reasonable, the extrusion stroke in the local extrusion technology can be guaranteed effectively, meanwhile, the defect of shrinkage porosity at the thick and large position of the product is reduced, production rejection rate is reduced, and the economic benefit of the enterprise is improved obviously.

BRIEF DESCRIPTION OF THE DRAWINGS

The embodiment of the disclosure will be described in detail below with reference to the drawings, wherein.

Figure 1:
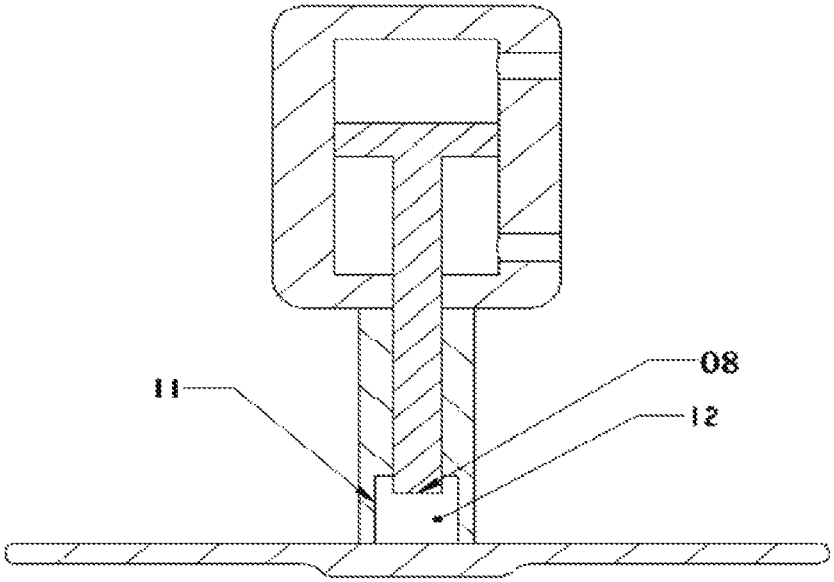
FIG. 1 is a structural schematic view of a local extrusion device for high-pressure casting before extrusion.
Figure 2:
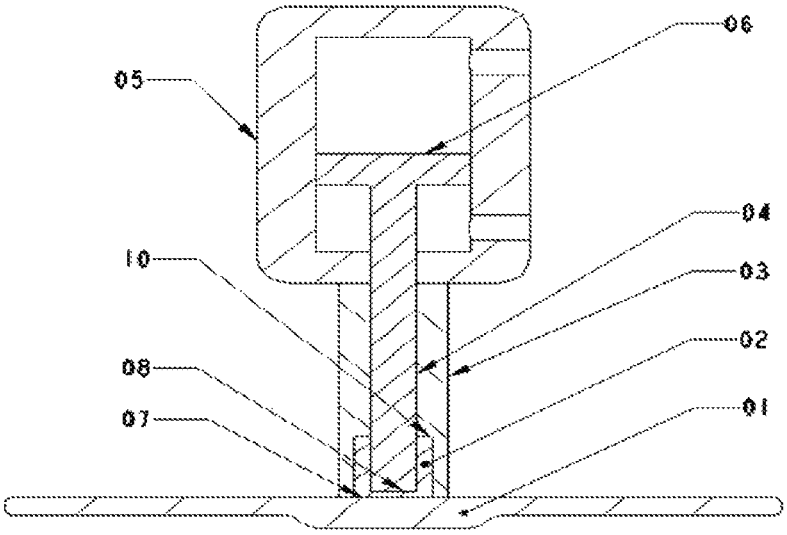
FIG. 2 is a structural schematic view of a local extrusion device for high-pressure casting after extrusion.

before extrusion; right figure: after extrusion); and

LIST OF REFERENCE SYMBOLS

01 casting
02 extrusion boss
03 extrusion core sleeve
04 extrusion rod
05 extrusion oil cylinder
06 extrusion oil cylinder piston
07 surface of casting
08 front end of extrusion rod
10 end surface of extrusion sleeve
11 lower cavity inner wall of extrusion core sleeve
12 cavity

DETAILED DESCRIPTION

Test Group 1

A local extrusion structure for aluminum alloy high-pressure casting includes an extrusion boss (02), an extrusion core sleeve (03), an extrusion rod (04), an extrusion oil cylinder (05) and an extrusion oil cylinder piston (06). The ratio of the cross sectional area of the extrusion oil cylinder piston (06) to the cross sectional area of the extrusion rod (04) is 12 to guarantee a big enough extrusion force. When the oil cylinder piston is not extruded (located at a zero position), a front end (08) of the extrusion rod is higher than an end surface (10) of the extrusion sleeve by 10 mm, and meanwhile, a cavity (12) is formed between the front end (08) of the extrusion rod and the lower cavity inner wall (11) of the extrusion core sleeve; in an extrusion process of the extrusion rod, a gap between the lower cavity inner wall (11) of the extrusion core sleeve and the outline of the extrusion rod (04) is 10 mm (which is also the range of the wall thickness of the extrusion boss (02)). In order to guarantee good extrusion effect of the local extrusion technology, local extrusion starting time and local extrusion delay time on a die-casting machine are adjusted, the extrusion stroke of the extrusion rod is enabled to reach 15 mm, the distance from the front end (08) of the extrusion rod to the surface (07) of a casting is 2 mm after extrusion, an X-ray flaw detection machine detects a thick and large part of the casting (01), and the result shows that the defect of shrinkage porosity does not exist. In the local extrusion technology, the extrusion starting time (timing is started at a two-speed transformation point) is 3 s, the extrusion delay time is 3 s, in a spraying cycle, the returned local extrusion core is required to be pushed out again for spraying to cool and lubricate the extrusion core well, jamming in the extrusion process is prevented, and the service life of the local extrusion core is prolonged.

Test Group 2

A local extrusion structure for aluminum alloy high-pressure casting includes an extrusion boss (02), an extrusion core sleeve (03), an extrusion rod (04), an extrusion oil cylinder (05) and an extrusion oil cylinder piston (06). The ratio of the cross sectional area of the extrusion oil cylinder piston (06) to the cross sectional area of the extrusion rod (04) is 12 to guarantee a big enough extrusion force. When the oil cylinder piston is not extruded (located at a zero position), a front end (08) of the extrusion rod is higher than an end surface (10) of the extrusion sleeve by 4 mm, and meanwhile, a cavity (12) is formed between the front end (08) of the extrusion rod and the lower cavity inner wall (11) of the extrusion core sleeve; and in an extrusion process of the extrusion rod, a gap between the lower cavity inner wall (11) of the extrusion core sleeve and the outline of the extrusion rod (04) is 4 mm (which is also the range of the wall thickness of the extrusion boss (02)). In order to guarantee good extrusion effect of the local extrusion technology, local extrusion starting time and local extrusion delay time on a die-casting machine are adjusted, the extrusion stroke of the extrusion rod is enabled to reach 10 mm, the distance from the front end (08) of the extrusion rod to the surface (07) of a casting is 3 mm after extrusion, an X-ray flaw detection machine detects a thick and large part of the casting (01), and the result shows that the defect of shrinkage porosity does not exist. In the local extrusion technology, the extrusion starting time (timing is started at a two-speed transformation point) is 0.5 s, the extrusion delay time is 8 s, in a spraying cycle, the returned local extrusion core is required to be pushed out again for spraying to cool and lubricate the extrusion core well, jamming in the extrusion process is prevented, and the service life of the local extrusion core is prolonged.

Test Group 3

A local extrusion structure for aluminum alloy high-pressure casting includes an extrusion boss (02), an extrusion core sleeve (03), an extrusion rod (04), an extrusion oil cylinder (05) and an extrusion oil cylinder piston (06). The ratio of the cross sectional area of the extrusion oil cylinder piston (06) to the cross sectional area of the extrusion rod (04) is 12 to guarantee a big enough extrusion force. When the oil cylinder piston is not extruded (located at a zero position), a front end (08) of the extrusion rod is higher than an end surface (10) of the extrusion sleeve by 10 mm, and meanwhile, a cavity (12) is formed between the front end (08) of the extrusion rod and the lower cavity inner wall (11) of the extrusion core sleeve; and in an extrusion process of the extrusion rod, a gap between the lower cavity inner wall (11) of the extrusion core sleeve and the outline of the extrusion rod (04) is 4 mm (which is also the range of the wall thickness of the extrusion boss (02)). In order to guarantee good extrusion effect of the local extrusion technology, local extrusion starting time and local extrusion delay time on a die-casting machine are adjusted, the extrusion stroke of the extrusion rod is enabled to reach 10 mm, the distance from the front end (08) of the extrusion rod to the surface (07) of a casting is 5 mm after extrusion, an X-ray flaw detection machine detects a thick and large part of the casting (01), and the result shows that the defect of shrinkage porosity does not exist. In the local extrusion technology, the extrusion starting time (timing is started at a two-speed transformation point) is 2 s, the extrusion delay time is 10 s, in a spraying cycle, the returned local extrusion core is required to be pushed out again for spraying to cool and lubricate the extrusion core well, jamming in the extrusion process is prevented, and the service life of the local extrusion core is prolonged.

Test Result

Specific tests are carried out in a research and development workshop of Engineering Technology Institute of CITIC Dicastal Co., Ltd. according to the above arrangement. The test result shows that the occurrence rate of casting wastes caused by the defect of shrinkage porosity at the thick and large position of the product in the test group 1, the test group 2 and the test group 3 are reduced by 70.24%, 76.20% and 87.15% respectively.

Thus, by the local extrusion devices in the different test groups, the number of casting wastes caused by the defect of shrinkage porosity at the thick and large position of the product is reduced. Moreover, by the extrusion device in the test group 3, the defect of shrinkage porosity at the thick and large position of the product is greatly reduced unexpectedly, and therefore, the production cost is remarkably reduced.

The embodiments described above are for illustrative technical concept and features of the disclosure, the purpose is to allow those skilled in the art to understand the contents of the disclosure and implement, and not to limit the scope of the disclosure. Where under the equivalent changes or modifications made in the spirit of the disclosure shall fall within the scope of the disclosure.

What is claimed is:

1. A local extrusion device for high-pressure casting, comprising an extrusion core sleeve, an extrusion rod, an extrusion oil cylinder and an extrusion oil cylinder piston, characterized in that, the extrusion oil cylinder comprises the extrusion oil cylinder piston, the extrusion oil cylinder piston is connected with the extrusion rod, the extrusion rod is positioned completely within the extrusion core sleeve and the extrusion oil cylinder, and the extrusion core sleeve and the extrusion oil cylinder are fixed together and directly contact with each other, wherein the extrusion core sleeve comprises a cavity at an end in proximity to a casting, the cavity having a diameter greater than the extrusion rod.

2. The local extrusion device for high-pressure casting according to claim 1, wherein a ratio of a cross sectional area of the extrusion oil cylinder piston to a cross sectional area of the extrusion rod is greater than 10.

3. The local extrusion device for high-pressure casting according to claim 1, wherein a ratio of a cross sectional area of the extrusion oil cylinder piston to a cross sectional area of the extrusion rod is 10-40.

4. The local extrusion device for high-pressure casting according to claim 1, wherein a ratio of a cross sectional area of the extrusion oil cylinder piston to a cross sectional area of the extrusion rod is 12.

5. The local extrusion device for high-pressure casting according to claim 1, wherein a front end of the extrusion rod is higher than an end surface of the extrusion core sleeve by 4-10 mm when the extrusion oil cylinder piston is not extruded.

6. The local extrusion device for high-pressure casting according to claim 1, wherein a gap between a lower cavity inner wall of the extrusion core sleeve and an outline of the extrusion rod is 4-10 mm.

7. The local extrusion device for high-pressure casting according to claim 1, wherein a ratio of a cross sectional area of the extrusion oil cylinder piston to a cross sectional area of the extrusion rod is 12; when the extrusion oil cylinder piston is not extruded, a front end of the extrusion rod is higher than an end surface of the extrusion core sleeve by 10 mm; and a gap between a lower cavity inner wall of the extrusion core sleeve and an outline of the extrusion rod is 4 mm.

* * * * *